US005975475A

United States Patent [19]

Chaplin

[11] Patent Number: 5,975,475

[45] Date of Patent: Nov. 2, 1999

[54] FIRE EXTINGUISHER HOLDER

[76] Inventor: Gregg S. Chaplin, 4871 Salem Dr., El Paso, Tex. 79924

[21] Appl. No.: 09/078,637

[22] Filed: May 14, 1998

[51] Int. Cl.[6] ..... A47K 1/08

[52] U.S. Cl. ..... 248/311.2; D12/419; 169/51

[58] Field of Search ..... 248/154, 311.2, 248/313, 314, 312, 312.1, 310; D12/223, 419; 47/39, 40, 41.01; 169/51

[56] References Cited

U.S. PATENT DOCUMENTS

| | | | |
|---|---|---|---|
| D. 221,217 | 7/1971 | Beychock | D12/419 |
| D. 252,121 | 6/1979 | Rutherford | D6/573 |
| D. 280,263 | 8/1985 | Hoye | D12/419 |
| D. 328,730 | 8/1992 | Kapp | D12/419 |
| 1,023,178 | 4/1912 | Stevens | 248/314 |
| 1,286,998 | 12/1918 | Graaff | 169/51 |
| 2,278,232 | 3/1942 | Anderson | 312/112 |
| 2,905,370 | 9/1959 | Pavol | D12/419 X |
| 3,921,950 | 11/1975 | Sentinella | 248/313 |
| 4,023,761 | 5/1977 | Molis | 248/313 |
| 4,482,123 | 11/1984 | Corbeil et al. | 248/542 |
| 5,025,935 | 6/1991 | Hadachek | 211/60.1 |
| 5,195,595 | 3/1993 | Nakagawa | 169/51 |
| 5,205,525 | 4/1993 | Peck | 248/311.2 |
| 5,423,508 | 6/1995 | Isenga et al. | 248/311.2 |
| 5,580,020 | 12/1996 | Catchings | 248/311.2 |

*Primary Examiner*—Ramon O. Ramirez
*Attorney, Agent, or Firm*—Richard C. Litman

[57] ABSTRACT

A fire extinguisher holder provides for the removable retention of a fire extinguisher therein, for use in the home, office, or other immovable structure where the immobility of the structure precludes any requirement for positive clamping or attachment of the extinguisher in the holder. The present holder comprises a back panel, a base for supporting a fire extinguisher thereon, and an encircling element for precluding lateral movement of the extinguisher until it is lifted clear of the encircling element. The present extinguisher holder is constructed as a single, unitary structure and is devoid of any movable extinguisher retaining elements which would otherwise have to be manipulated in order to remove the extinguisher from the holder. The present holder allows a fire extinguisher held therein to be removed quickly and easily, without any requirement for releasing retaining straps and the like. The present extinguisher holder may be constructed of various materials, but is preferably constructed of wood, in order to provide an attractive appearance and encourage installation in the home or office, thereby promoting safety. Other elements of the present holder, such as the concave insets and convex curvature of the upper portion of the back panel, provide functional advantages, such as clearance for grasping the extinguisher and removal of sharp corners, as well as providing an attractive appearance for the device.

14 Claims, 2 Drawing Sheets

FIRE EXTINGUISHER HOLDER

BACKGROUND OF THE INVENTION

1. Field of the Invention

The present invention relates generally to brackets, holders, and mounting structures for various articles, and more specifically to an open holder for a fire extinguisher or the like. The holder includes a solid base with an open upper retainer, allowing the extinguisher to be quickly and easily removed from the holder without need to manipulate or remove any other clamps or other attachments which would otherwise positively hold the extinguisher in place.

2. Description of the Related Art

The need for emergency equipment in the home has been acknowledged for some time, with it being recognized that most accidents occur in and around the home. Many insurance companies have recognized this problem, and accordingly have offered reductions in premiums for households having certain safety equipment (e. g., smoke detectors and fire extinguishers) available and operational in the home.

While smoke detectors are typically permanently mounted to some ceiling structure somewhere in the home, little, if anything, has ever been done to provide a secure, yet easily accessible, mounting or storage means for a hand held fire extinguisher in the home. Most homeowners have merely placed their extinguishers on a countertop or some other easily accessible area. This is generally not particularly suitable, as (1) the extinguisher takes up counter space, and (2) it is generally not particularly well located, generally being placed near the back of the countertop adjacent the wall.

Fire extinguisher holders developed in the past have universally included some means of positively securing the extinguisher within the holder or bracket, requiring a user of the extinguisher to manipulate the clamp or other retainer before being able to remove the extinguisher for use. This is because most such devices were never intended for use in the home, but rather were developed for use in motor vehicles, boats, aircraft, etc., where the positive attachment of an otherwise loose article such as a fire extinguisher is important. As time is generally critical when a fire extinguisher is required, the extra time required to unfasten clamps, straps, or other securing devices from the extinguisher before being able to remove it from its holder, can make a difference as to whether the emergency is successfully met or not. This is particularly true in the case of a younger person, who may have difficulty in understanding how the fire extinguisher retaining means of such a holder is operated. Moreover, such prior art fire extinguisher brackets and mounts have generally had a rather utilitarian appearance, and have not really been suitable for use in the home, as they are not generally compatible with the interior decor of the home.

Accordingly, a need is apparent for a fire extinguisher holder for use in the interior of the home, or other similar area, for holding and securing a fire extinguisher on a wall or other suitable structure where it remains clear of counterspace or other horizontal surfaces. The present holder provides secure retention of a fire extinguisher held therein, but also provides immediate access to the extinguisher without need to remove clamps, straps, or other positive attachment means for the extinguisher prior to use. The present holder responds to this problem, while simultaneously providing an attractive device suitable for display in the home environment.

A discussion of the related art of which the present inventor is aware, and its differences and distinctions from the present invention, is provided below.

U.S. Pat. No. 2,278,232 issued on Mar. 31, 1942 to Peter A. Anderson, titled "Gas Installation Housing," describes a bracket and hinged cover for securing a gas cylinder to another structure. The cover serves to cover any valves, regulators, etc. extending from the top of the cylinder, and is locked in place to preclude access to the cylinder. Accordingly, the cylinder cannot be removed from the housing and structure to which the housing is attached, without the appropriate key. This arrangement is totally unsuitable for a fire extinguisher, where immediate access is essential. Moreover, Anderson does not disclose any underlying support structure, other than the existing shelf. The present holder does not make use of any existing horizontal surfaces.

U.S. Pat. No. 3,921,950 issued on Nov. 25, 1975 to Victor E. Sentinella, titled "Extinguisher Mountings," describes several embodiments of over center lever latching mechanisms for securing a fire extinguisher in a holder or bracket therefor. One embodiment of the holder is an open, generally rectangular frame providing access to the extinguisher from only one side even when the over center latch bar has been released. Other embodiments are more open, but nevertheless preclude removal of an extinguisher from the sides of the holders due to at least partially surrounding components communicating with the over center latch mechanisms. In contrast, the present fire extinguisher holder is devoid of all moving, clamping, and latching components and the like, enabling an extinguisher held therein to be lifted directly from the present holder without need to manipulate any other components first.

U.S. Pat. No. 4,023,761 issued on May 17, 1977 to John Molis, titled "Adjustable Bracket To Stabilize Upright Compressed Gas Containers Against Displacement On Mobile Vehicles And ShipBoard Installations And Maintenance Shops," describes a continuously encircling clamp which is removably attachable to an existing wall bracket (angle iron or the like) . The clamp positively attaches about the cylinder by means of a threaded bolt, which clamps a pair of opposed shoes to opposite sides of the cylinder. Molis relies upon the existing underlying structure to support the cylinder. The Molis clamp is not adapted for providing ready access to a fire extinguisher, but rather for securely holding gas cylinders and the like in a vehicle for transport.

U.S. Pat. No. 4,482,123 issued on Nov. 13, 1984 to Romain Corbeil et al., titled "Support Device For A Fire Extinguisher," describes a hook with a tab which is spring loaded to close the mouth of the hook to preclude rehanging the extinguisher after it has been removed. The tab must be moved to open the hook again, using a special key. The Corbeil et al. hook provides ready access to an extinguisher, but the extinguisher requires a hanging ring for support by the hook, as the hook does not provide any underlying support of the extinguisher. Most extinguishers are provided with a pull ring attached to a safety pin through the actuating handle, but it is not desirable to hang an extinguisher from this pin, as it may pull out and allow the extinguisher to fall and discharge. The present holder provides an attractive device for securely holding and supporting a fire extinguisher from beneath, while still providing ready access.

U.S. Pat. No. 5,025,935 issued on Jun. 25, 1991 to Josh L. Hadachek, titled "Portable Upright Scuba Cylinder Retention Rack," describes a rack having a bottom and a top portion secured together by a telescoping tube. The two portions are wedged between the upper rail and floor of a pickup truck or the like by the compressive force of a spring within the tube. A bungee cord or the like wraps around the two tanks carried by the device, to secure them therein. In contrast, the present holder provides a permanent, rigid retaining structure about a single cylinder, and allows the cylinder to be lifted therefrom without need for removal of other components.

U.S. Pat. No. 5,195,595 issued on Mar. 23, 1993 to Henry Nakagawa, titled "Fire Extinguisher Mounting Apparatus," describes an enclosed, transparent plastic box for completely enclosing a fire extinguisher therein. The box has a front opening panel thereon, permanently secured to the remaining structure by hinges at the bottom and temporarily secured at the top by a pair of frangible pins. The pins must be replaced each time the box is opened. The present fire extinguisher holder does not enclose a fire extinguisher therein, but rather supports the extinguisher below its base and about its circumference. The present extinguisher holder has no moving components, and needs no reassembly or replacement of parts after a fire extinguisher is removed therefrom and replaced.

U.S. Pat. No. 5,423,508 issued on Jun. 13, 1995 to Steven R. Isenga et al., titled "Foldable Support For Beverage Container," describes a device having an upwardly folding bottom support and laterally adjustable arms for removably holding a beverage cup or the like therein. The Isenga et al. support is formed of relatively thin and flexible materials, and is not suitable for supporting a much larger and heavier article, such as a fire extinguisher, even if scaled up in size. The present fire extinguisher holder is a rigid structure and does not contain any moving parts, thus providing a much more solid and sturdy means of holding a fire extinguisher. The surrounding support of the present extinguisher holder completely encircles the extinguisher, unlike the open arms of the Isenga et al. device.

Finally, U.S. Pat. No. D-252,121 issued on Jun. 19, 1979 to James E. Rutherford, titled "Fire Extinguisher Wall Mounted Cabinet," illustrates a design for a generally rectangular box structure having one open side providing access to a fire extinguisher contained therein. The open side has a strap which is extended thereacross to hold the extinguisher securely within the box. Again, the present fire extinguisher holder is devoid of such clamps, straps, and other positive attachment components, thus allowing a fire extinguisher held therein to be removed for use quickly and easily. Moreover, the depth of the Rutherford design would require that the adjacent wall be cut out so the box could be installed with its forward flange flush with the surface of the wall. The present holder utilizes a flat panel for securing to a wall surface.

None of the above inventions and patents, either singly or in combination, is seen to describe the instant invention as claimed.

SUMMARY OF THE INVENTION

The present invention comprises a fire extinguisher holder for use in the home or other stationary structure. The present holder basically comprises a flat back panel for mounting to a wall or other generally vertical surface as desired, a base component upon which a fire extinguisher may rest, and a laterally encircling holder. The base and lateral holder extend outwardly from the back panel, and are normal thereto. The base may include additional bracing therebeneath to support the weight of the fire extinguisher.

The present fire extinguisher holder is devoid of any movable parts or components, and does not require any manipulation of clamps, levers, or other mechanisms to remove the fire extinguisher therefrom. A fire extinguisher held in the present holder need only be lifted so the base clears the encircling component, for removal therefrom. The extinguisher is easily replaced by inserting the base through the encircling component to rest upon the base component therebelow. The present holder is particularly suited for use in the home, office, or other stationary structure where no motion exists to require positive retention of the extinguisher in the holder, and its various structural elements provide an attractive as well as functional device.

Accordingly, it is a principal object of the invention to provide an improved fire extinguisher holder for use in the home, office, or other stationary structure where movement of the structure does not occur.

It is another object of the invention to provide an improved fire extinguisher holder which has no moving components requiring release for removal of the extinguisher from the holder.

It is a further object of the invention to provide an improved fire extinguisher holder comprising a back panel for mounting on a wall or other vertical structure, a base and base support for supporting a fire extinguisher thereon, and an encircling element disposed above the base for precluding lateral movement of the extinguisher in the holder until the extinguisher is lifted above the encircling element.

An additional object of the invention is to provide an improved fire extinguisher holder which base and encircling elements are substantially normal to the back panel.

Still another object of the invention is to provide an improved fire extinguisher holder which functional features, such as the use of wood as a structural material, concave elements of the back panel for clearance when removing the extinguisher therefrom, and curved upper edge devoid of sharp corners, also provide an attractive appearance for use in the home or office.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
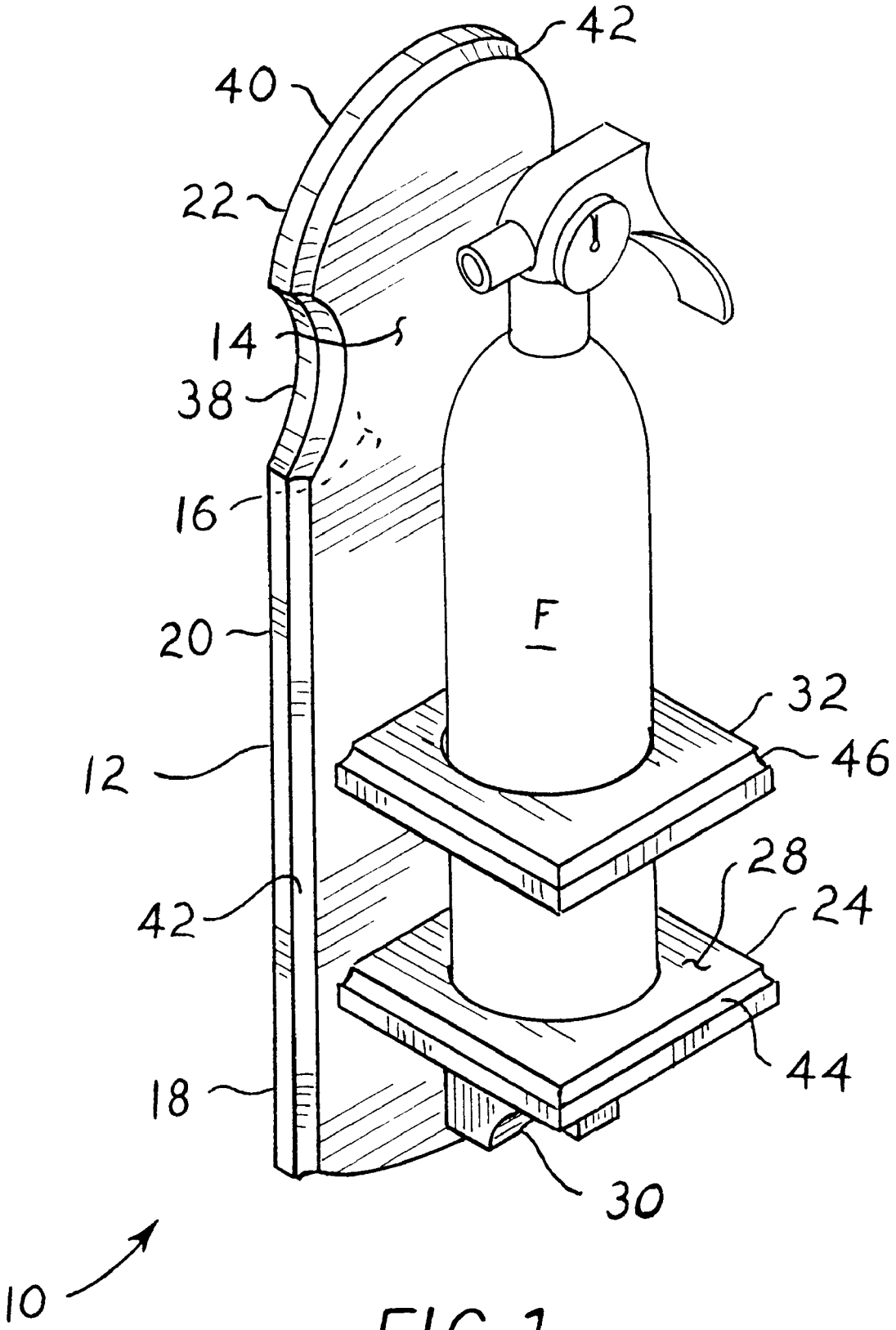
FIG. 1 is an environmental perspective view of the present fire extinguisher holder with a fire extinguisher being held therein, showing the various features of the present holder.

The present invention comprises a functional and decorative holder for a fire extinguisher, for use in the home, office, or other stationary structure where positive clamping or attachment means are not required to secure the extinguisher in the holder. The present holder, designated by the reference numeral 10 in the drawing figures, is adapted for holding a conventional portable, hand held fire extinguisher F therein, as shown in FIG. 1 of the drawings.

The holder 10 includes a back panel 12 adapted for removable or permanent attachment or mounting to a vertical surface (wall, cabinet side, etc.) in the kitchen, garage, shop, or other area where the need for a fire extinguisher might arise. The back panel 12 comprises a flat, rigid, elongate sheet of material having a front surface 14 and an opposite rear surface 16, with a lower portion 18, intermediate portion 20, and upper portion 22.

A base component 24 comprising a generally flat, rigid sheet of material extends from the front surface 14 of the lower portion 18, and serves to support the base of the fire extinguisher F thereon. (The base component 24 may include an inset 26 in the upper surface 28 thereof, shown in FIG. 2, to preclude lateral movement of the base of the fire extinguisher F while the extinguisher F is seated therein.) The base component 24 is preferably normal to the back panel 12, with a base support 30 extending from the lower portion 18 of the back panel and beneath the base component 24, to support and strengthen the base component.

A flat, rigid fire extinguisher encircling element 32 extends from the front surface 14 of the back panel 12, preferably from a location above the base component 24 and below the intermediate portion 20 of the back panel 12. The encircling element 32 and base component 24 each define a plane, with the two planes being parallel to one another and both normal to the back panel 12. The extinguisher encircling element 32 includes a fire extinguisher body passage 34 therethrough, configured to fit reasonably closely about the body or cylinder of the fire extinguisher F, to preclude lateral movement of the fire extinguisher F while it is resting in the present fire extinguisher holder 10. The passage 34, as well as the depression or inset 26 which may be provided optionally within the base component 24, may be configured to fit any practicable size or shape of extinguisher, with the fire extinguisher F shown in FIG. 1 being exemplary.

Figure 2:
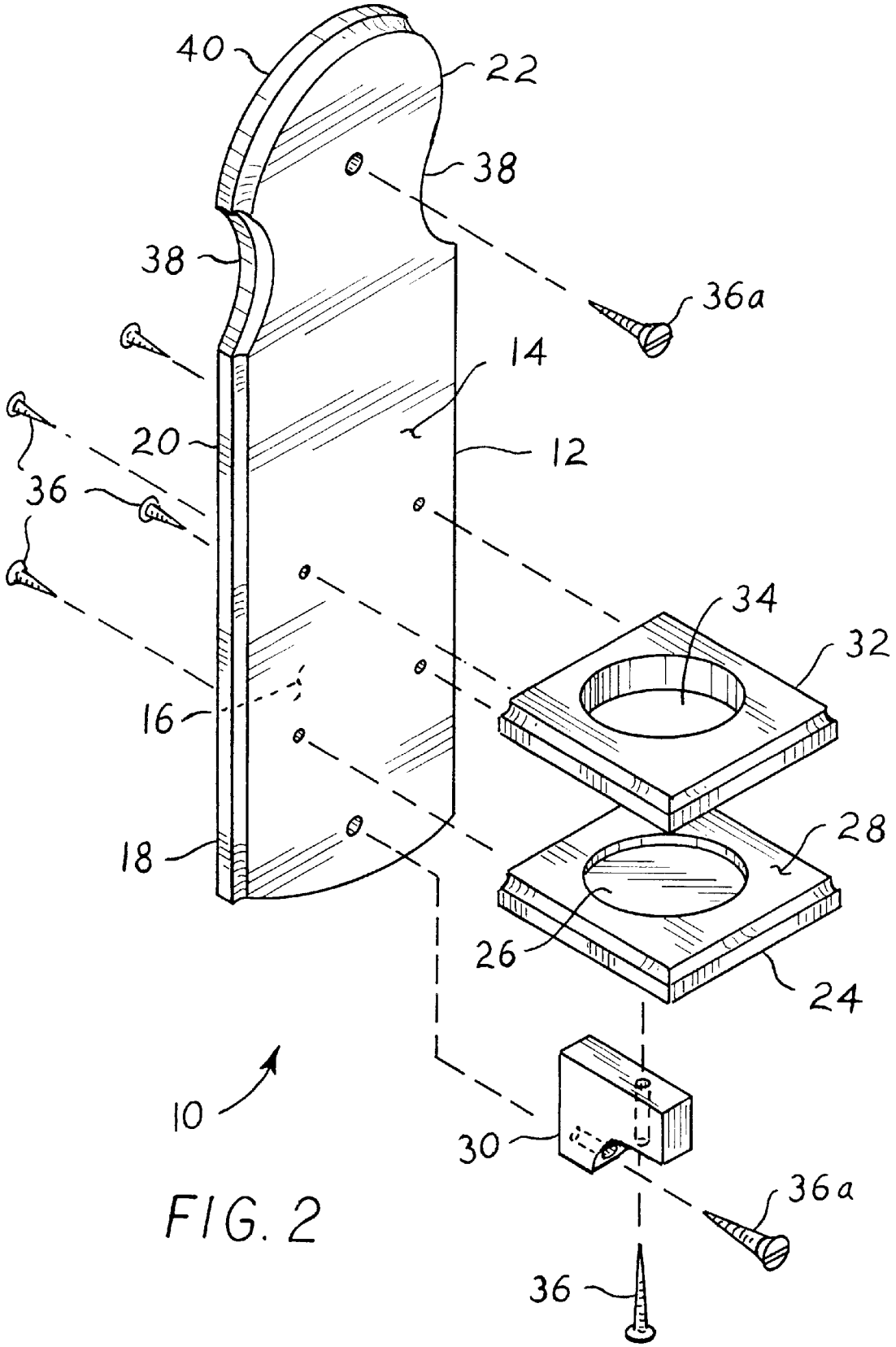
FIG. 2 is an exploded perspective view of a slightly modified fire extinguisher holder of the present invention, showing further details thereof.

The four components of the fire extinguisher holder 10, i. e., the back panel 12, base component 24, base support bracket 30, and extinguisher encircling element 32, are rigidly secured together by any practicable means, e. g., the screws 36 shown in FIG. 2, and/or glues, nails, etc., to form a rigid, unitary structure which is devoid of any movable fire extinguisher attachment means or other movable components. One or more of the screws, e. g., screws 36*a,* may have sufficient length to extend through the back panel 12, to secure the extinguisher holder 10 positively to a supporting surface. Alternatively, a conventional hanger (not shown) may be used to hang the holder 10 from another surface.

The present fire extinguisher holder 10 provides a practical means of securing a fire extinguisher F in a convenient but out of the way location, yet provides immediate access to the extinguisher F when it is needed. Yet, many of the features of the present holder 10 which provide such practicality, also provide an attractive appearance to encourage the installation of the present holder 10 in any location where a fire extinguisher F may be needed. For example, the upper portion 22 of the back panel 12 includes insets 38 formed in the opposite edges thereof, with the insets 38 providing not only a decorative appearance, but also providing some increased hand clearance for a person who may be hurriedly grasping the fire extinguisher F in an emergency situation. Also, the upper edge 40 of the back panel 12 may be smoothly curved, again not only adding to the attractive appearance of the present extinguisher holder 10, but also providing a surface devoid of sharp corners which might otherwise inflict some injury to the hand of a person who might be grasping the fire extinguisher F held in the holder 10 in an emergency.

It will also be noted that the peripheries of the back panel 12, base component 24, and encircling element 32 may each include a relief, respectively 42, 44, and 46, which is devoid of any sharp corners which might otherwise cause injury to a person hurriedly reaching for a fire extinguisher F held by the present extinguisher holder 10 in an emergency situation. The reliefs 42 through 46 also provide attractive elements to enhance the visual appearance of the present fire extinguisher holder 10.

In summary, the present fire extinguisher holder will be seen to provide a most attractive, as well as useful, means of providing ready access to a fire extinguisher in any location where such an extinguisher may be needed in a fixed structure. The holder may be installed in any practicable location, preferably to a generally vertical surface such as a wall, cabinet or cupboard end, etc., where the holder provides for the holding of a fire extinguisher with the extinguisher remaining clear of any horizontal shelf or counter space yet being readily available in case of need. The present holder is free of all positive attachments for the extinguisher, with a person needing the extinguisher held by the present holder needing only to lift the extinguisher upwardly by a very few inches so the base of the extinguisher clears the encircling element. Yet, the extinguisher is securely held in place in the holder for storage and ready access, with the base component supporting the extinguisher and the encircling element precluding any lateral displacement of the extinguisher while it is held in the holder.

The present fire extinguisher holder may be formed of any practicable materials, such as wood, plastic, or even metal, if so desired. Many of the functional features of the present holder also provide an attractive appearance, and it is desired to provide as attractive appearance as possible, to encourage the installation of the present holder in the home where a fire extinguisher may be held therein for ready access in the event it is needed. Accordingly, the present fire extinguisher holder may be varnished or otherwise coated to display the attractive grain pattern of the material used if it is constructed of wood, or may alternatively be painted or formed of plastic in a variety of colors to complement the decor of the area of the home, office, or other structure in which the present holder may be installed. It will also be seen that the present holder may be constructed in virtually any practicable size and configuration, in order to fit a wide variety of sizes, shapes, and configurations of fire extinguishers. Thus, the present holder in any of its forms or embodiments will be seen to provide a most needed and useful accessory for the home, office, and/or other area where rapid access to a fire extinguisher might ever be needed.

It is to be understood that the present invention is not limited to the sole embodiment described above, but encompasses any and all embodiments within the scope of the following claims.

I claim:

1. A fire extinguisher holder for supporting a fire extinguisher having a circular base, said fire extinguisher holder comprising:

a rigid, flat, elongate back panel having a lower portion, an intermediate portion, an upper portion, a front surface, and a rear surface, said back panel including a pair of opposite side edges and a width extending between said side edges, said back panel defining at least one hole extending from said front surface to said rear surface, said hole being dimensioned and configured to receive a fastener for attaching said back panel to a vertical surface;

a rigid planar base component having a pair of side edges defining a width therebetween, said base component's width being substantially equal to said back panel's width, said back panel horizontally extending from said lower portion of said front surface of said back panel and normal thereto, said base component having an upper surface including a circular inset formed therein, said circular inset being dimensioned for seating and laterally retaining the base of the fire extinguisher therein;

a rigid planar encircling element having a pair of side edges defining a width therebetween, said encircling element's width being substantially equal to said back panel's width, said encircling element horizontally extending from said front surface of said back panel and normal thereto, and above said base component, said encircling element defining a circular opening concentric with said circular inset of said base, said encircling element being dimensioned and configured for completely encircling the fire extinguisher and for precluding direct lateral movement of the fire extinguisher removably retained thereby;

a vertically oriented base support extending from said lower portion of said back panel and beneath said base component for supporting and strengthening said base component, said base support having a top edge attached to said base component and a side edge attached to said back panel;

said base component and said encircling element being parallel to one another; and said back panel, said base component, said encircling element, and said base support forming a rigid, unitary structure devoid of movable fire extinguisher attachment means thereon.

2. The fire extinguisher holder according to claim 1, wherein at least said back panel, said base component, and said encircling element are formed of wood.

3. The fire extinguisher holder according to claim 1, wherein at least said back panel, said base component, and said encircling element are formed of plastic.

4. The fire extinguisher holder according to claim 1, wherein said encircling element is disposed below said intermediate portion of said back panel.

5. The fire extinguisher holder according to claim 1, wherein said back panel, said base component, and said encircling element each have a periphery, with each said periphery including a relief devoid of sharp corners therealong, for precluding injury to a user of the fire extinguisher when the fire extinguisher is removed from said holder.

6. The fire extinguisher holder according to claim 1, wherein said upper portion of said back panel includes opposite edges each having an inset formed therein for providing clearance for the hand of a user of the fire extinguisher when the fire extinguisher is removed from said holder.

7. The fire extinguisher holder according to claim 1, wherein said upper portion of said back panel includes a smoothly curved upper edge devoid of sharp corners, for precluding injury to a user of the fire extinguisher when the fire extinguisher is removed from said holder.

8. A fire extinguisher and fire extinguisher holder therefor, comprising in combination:

a portable, hand held fire extinguisher;

a fire extinguisher holder comprising a rigid, flat, elongate back panel having a lower portion, an intermediate portion, an upper portion, a front surface, and a rear surface, said back panel including a pair of opposite side edges and a width extending between said side edges, said back panel defining at least one hole extending from said front surface to said rear surface, said hole being dimensioned and configured to receive a fastener for attaching said back panel to a vertical surface;

a rigid planar base component having a pair of side edges defining a width therebetween, said base component's width being substantially equal to said back panel's width, said back panel horizontally extending from said lower portion of said front surface of said back panel and normal thereto, said base component having an upper surface including a circular inset formed therein, said circular inset being dimensioned for seating and laterally retaining the base of the fire extinguisher therein;

a rigid planar encircling element having a pair of side edges defining a width therebetween, said encircling element's width being substantially equal to said back panel's width, said encircling element horizontally extending from said front surface of said back panel and normal thereto, and above said base component, said encircling element defining a circular opening concentric with said circular inset of said base, said encircling element being dimensioned and configured for completely encircling the fire extinguisher and for precluding direct lateral movement of the fire extinguisher removably retained thereby;

a vertically oriented base support extending from said lower portion of said back panel and beneath said base component for supporting and strengthening said base component, said base support having a top edge attached to said base and a side edge attached to said back panel;

said base component and said encircling element being parallel to one another; and said back panel, said base component, said encircling element, and said base support forming a rigid, unitary structure devoid of movable fire extinguisher attachment means thereon.

9. The fire extinguisher and fire extinguisher holder combination according to claim 8, wherein said upper portion of said back panel of said fire extinguisher holder includes opposite edges each having an inset formed therein for providing clearance for the hand of a user of said fire extinguisher when said fire extinguisher is removed from said holder.

10. The fire extinguisher and fire extinguisher holder combination according to claim 8, wherein said upper portion of said back panel of said fire extinguisher holder includes a smoothly curved upper edge devoid of sharp corners, for precluding injury to a user of said fire extinguisher when said fire extinguisher is removed from said holder.

11. The fire extinguisher and fire extinguisher holder combination according to claim 8, wherein said back panel, said base component, and said encircling element of said fire extinguisher holder each have a periphery, with each said periphery including a relief devoid of sharp corners therealong, for precluding injury to a user of said fire extinguisher when said fire extinguisher is removed from said holder.

12. The fire extinguisher and fire extinguisher holder combination according to claim 8, wherein at least said back panel, said base component, and said encircling element of said fire extinguisher holder are formed of wood.

13. The fire extinguisher and fire extinguisher holder combination according to claim 8, wherein at least said back panel, said base component, and said encircling element of said fire extinguisher holder are formed of plastic.

14. The fire extinguisher and fire extinguisher holder combination according to claim 8, wherein said encircling element of said fire extinguisher holder is disposed below said intermediate portion of said back panel.

* * * * *